US010130991B2

(12) United States Patent
Hen

(10) Patent No.: US 10,130,991 B2
(45) Date of Patent: Nov. 20, 2018

(54) CASTING SYSTEM AND A METHOD OF CASTING USING THE SAME

(71) Applicant: Ofer Hen, Gesher Haziv (IL)

(72) Inventor: Ofer Hen, Gesher Haziv (IL)

( * ) Notice: Subject to any disclaimer, the term of this patent is extended or adjusted under 35 U.S.C. 154(b) by 417 days.

(21) Appl. No.: 14/861,322

(22) Filed: Sep. 22, 2015

(65) Prior Publication Data

US 2016/0082506 A1 Mar. 24, 2016

(30) Foreign Application Priority Data

Sep. 23, 2014 (IL) ..... 234824

(51) Int. Cl.

| | |
|---|---|
| ***B22D 18/06*** | (2006.01) |
| ***B22D 45/00*** | (2006.01) |
| ***B22C 9/04*** | (2006.01) |

(52) U.S. Cl.

CPC ..... *B22D 18/06* (2013.01); *B22C 9/04* (2013.01); *B22D 45/00* (2013.01); *B22D 45/005* (2013.01)

(58) Field of Classification Search

CPC ..... B22D 18/06; B22D 45/00; B22D 45/005; B22C 9/04

See application file for complete search history.

(56) References Cited

U.S. PATENT DOCUMENTS

| | | | |
|---|---|---|---|
| 4,579,166 | A | 4/1986 | Neelameggham et al. |
| 4,784,207 | A | 11/1988 | Di Maio |
| 4,825,934 | A | 5/1989 | Kai |
| 4,915,155 | A | 4/1990 | Martin |
| 5,896,913 | A | 4/1999 | Grandi |
| 7,475,717 | B2 | 1/2009 | Chikugo et al. |

FOREIGN PATENT DOCUMENTS

| | | |
|---|---|---|
| EP | 1027180 | 8/2000 |
| GB | 774287 | 5/1957 |

*Primary Examiner* — Kevin P Kerns
*Assistant Examiner* — Steven S Ha

(57) ABSTRACT

A casting system includes a casting surface; a rim area disposed on the casting surface or associated therewith; a heat resistant impermeable diaphragm having an edge area. The diaphragm covers a portion of the casting mold when it is positioned on the surface so as to form a space defined by at least a base constituted by the surface, and at least a casting face constituted, at least partially, by the diaphragm; a sealing arrangement for sealingly engaging the rim and edge areas, thereby sealing the space; an outlet for withdrawing gas from the space; a heat resistance coefficient of the diaphragm is such that it can melt when coming in contact with the molten material. The diaphragm covers an area larger than that through which molten material is case so that, when the space is sealed, vacuum application causes the diaphragm to adhere to a portion of the mold.

11 Claims, 7 Drawing Sheets

CASTING SYSTEM AND A METHOD OF CASTING USING THE SAME

CROSS-REFERENCE TO RELATED APPLICATIONS

This application claims priority to Israel Patent Application No. 234824 filed on 23 Sep. 2014, the disclosure of which is incorporated herein, in its entirety, by this reference.

TECHNOLOGICAL FIELD

Embodiments disclosed herein relate to a precision casting process, in particular for investment casting.

BACKGROUND

The use of vacuum for investment casting is well known by the use of a flask, which is a permeable frame, into which the slurry is poured after the wax model has been mounted. The flask is generally perforated with a flange at one edge that fits in a way that prevents vacuum leakage. After drying and heating, the flask is mounted in a vacuum chamber, which enables a pressure difference effect.

There is known a variety of systems, methods and accessories for investment casting, some examples of which are disclosed below:

U.S. Pat. No. 4,825,934 to Kai suggested a cushioning sheet made of flammable material. It is inserted into a casting frame and adapted so that it burns out when heated to leave a space between the casting frame and the casting mold.

U.S. Pat. No. 5,896,913 to Grandi suggested Investment casting paper and guard. The paper acts as both vacuum liner and splash guard. It is fabricated as a perforated paper sheet having hooks which is inserted in a cylindrical manner into the casting flask and burns out when heated.

U.S. Pat. No. 4,915,155 to Martin suggested a solution to annul the vacuum chamber. An integral casting flask/vacuum chamber combination is disclosed in which an inner perforated tube forming the casting flask is disposed coaxially inside of an outer tube, thus forming a vacuum chamber between the two tubes.

Another alternative to eliminating the need for the flask was suggested by EP1027180 to Ashton. It consists of placing the shell in a mold box and surrounding it with granular filler, vibrating the box to compact the filler to a high bulk density and then applying a vacuum to the granular filler.

In order to get a uniform and controlled atmosphere, several machines with vacuum valves have been developed in a way that protective gas can be used before the vacuum process.

U.S. Pat. No. 4,784,207 to Maio suggested an apparatus for lost wax castings wherein metal is melted in a vacuum vessel, and wherein there are provided vacuum pumps for producing a higher degree of vacuum around the mold during casting.

GB774287 to Turnbull suggests a method in which a shell is positioned within an evaluable container and a thin diaphragm of suitable material, for example stainless steel for the production of steel alloy casting, is positioned so as to extend across a pouring throat for the entry of the casting material to the interior of the mold. In the pouring operation the molten metal accumulates above the diaphragm, which does not melt immediately. The metal is poured thereon, so that the slag and any air entrained in the metal will rise to the surface. When the diaphragm melts the metal flows into the mold cavity.

U.S. Pat. No. 4,579,166 to Neelameggham suggested impregnation of at least the pores adjacent to the mold cavity with pressurized gas as a principal inhibiting agent, using a purge cup which fits tightly over the sprue.

Acknowledgement of the above references herein is not to be inferred as meaning that these are in any way relevant to the patentability of the presently disclosed subject matter.

GENERAL DESCRIPTION

According to one aspect of the subject matter of the present application, there is provided a casting system for the manufacture of a cast item by means of poring molten casting material in a casting mold, said system comprising:

- a casting surface for positioning thereon the casting mold;
- a rim area disposed on the casting surface or associated therewith;
- a heat resistant impermeable diaphragm having a predetermined heat resistance coefficient and an edge area, and configured for covering a portion of said casting mold when the latter is positioned on said casting surface so as to form a casting space defined by at least a base constituted by said casting surface, and at least a casting face constituted, at least in part, by the diaphragm;
- a sealing arrangement configured for sealingly engaging the rim area of the casting surface and the edge area of the diaphragm, thereby sealing said casting space;
- at least one outlet configured for withdrawing gas from said sealed casting space;

wherein said heat resistance coefficient is such that the diaphragm can melt when coming in contact with the molten casting material, and wherein the diaphragm is flexible enough and covers an area larger than that through which molten material is case so that, when the casting space is sealed, application of vacuum to the sealed casting space through said at least one outlet causes the diaphragm to deform and shrink, thereby adhering to a portion of the casting mold located juxtaposed with the casting face.

The term 'casting face' refers herein to that side of the casting space from which direction the molten material is cast into the mold. In many cases, casting of the material is performed from a top side of the casting space, wherein the casting face is considered to be the top face of the casting space, i.e. the face facing the source of the molten material.

The rim area can be constituted by a part of the casting surface itself, in which case the diaphragm can be configured for covering the majority of the casting mold, thereby constituting not only the casting face of the casting space but also the remainder of the casting space except the base. Alternatively, the casting surface can be provided with a projecting side wall having, at an end thereof remote from the casting surface, the rim area. In this case, the diaphragm can constitute a majority or at least a part of only the casting face while the side portion of the casting space is constituted by the side wall.

In the former example of a rim area situated on the casting surface itself, the diaphragm can thus almost fully wrap and encompass the casting mold, while in the latter example, in which the rim area is elevated, the diaphragm can wrap and adhere only to a majority, or at least a part of the casting face of the casting mold.

It is important to note that since the diaphragm is dimensioned to have a greater area than the casting opening through which molten material is poured into the mold, it is sufficient for the diaphragm to cover a boundary area around the casting opening, thereby maintaining vacuum even after a part of the diaphragm melts during said casting.

Specifically, the diaphragm is so dimensioned that it can have a central portion configured for being juxtaposed with the opening of the mold through which molten material is poured therein, and a peripheral area, constituting the boundary area, which adheres to the casting mold under the application of vacuum. Thus, when the central area of the diaphragm is breached by being melted away by the cast molten material, the peripheral area is still adhered to the casting mold, maintaining the required vacuum during casting. It is noted that since the diaphragm is breached, the level of vacuum may not be identical to that before the breaching, but it is still sufficient for maintaining a required level for the purpose of casting.

The vacuum produced through said at least one outlet can be sufficient for withdrawing at least part of the gas residing in pours of the casting mold.

In addition, the casting surface can further comprise a stand configured for positioning thereon the casting mold, said stand configured to provide a space between said casting mold and said at least one outlet.

The system can further comprise at least one inlet configured for introduction of gas into the casting space.

In connection to the above, the diaphragm can be flexible enough so that, when the casting space is sealed, application of gas through said at least one inlet, causes the diaphragm to inflate.

The diaphragm can be provided with at least one protective element configured for preventing droplets of molten casting material from coming in contact with the diaphragm. As common in the field, the molten casting material can be liquid metal.

According to another aspect of the subject matter of the present application, there is provided a method for casting using the casting system of the previous aspect of the present application, said method including the steps of:

a) positioning the casting mold on the casting surface;

b) covering the casting mold with the diaphragm while sealingly attaching the edge area of the diaphragm to the rim area of the casting surface using the sealing arrangement, thereby forming a sealed casting space;

c) generating a vacuum through said at least one outlet until the diaphragm adheres to the casting mold; and d) pouring molten casting material onto the diaphragm at the mold's sprue, causing the diaphragm to melt and form an opening into said sprue, allowing the molten casting material to flow through said opening into the casting mold.

In principle, the casting mold is wrapped with an impermeable flexible diaphragm (also "impermeable diaphragm", "diaphragm"). The diaphragm is inflated with a protective gas before casting and can be put aside for some time to insure good penetration to the casting mold. By vacuum operation most, but not all of the protective gas dissipates, and the diaphragm wraps the casting mold. When the diaphragm is adhered to the sprue the metal is poured. The metal heat melts the diaphragm above the sprue and the vacuum pulls the metal into the cavity.

The method can further include a preliminary step (0) of placing a stand on said casting surface, onto which said casting mold is set in step (a) of the method, said stand spacing the casting mold from the at least one outlet.

The method can also include a step (b') of introducing gas through at least one inlet of the system to penetrate pours of the casting mold and causing the diaphragm to inflate. In addition, a step (b") can be implemented during which the gas introduced through the at least one inlet is allowed to linger within the casting space to better permeate the casting mold.

The method can also include a step (c') of providing at least one protective element onto the diaphragm before step (d), configured for preventing droplets of molten casting material from coming in contact with the diaphragm.

The vacuum is such that includes two steps of operation, in that order:

C1) adherence of the diaphragm to the sides of the casting mold; and

C2) suction of the diaphragm into a sprue of the casting mold.

In order to finish the molding process, the final steps of the method can include:

e) cooling down the casting mold; and f) removing the diaphragm to extract the casting mold.

According to still another aspect of the subject matter of the present application, there is provided a casting mold configured for introducing therein molten casting material to form a cast item, said casting mold having a body and a main layer external to the body and made of a permeable material, the main layer being integrally formed with said body and being bonded thereto by the material of the body extending into the permeable material, thereby forming a transition layer therebetween.

The transition layer can reduce the chance of cracks being formed in the mold during cooling.

The main layer can be made of a fibrous material, for example, a ceramic blanket. The material is such that the main layer is permeable enough so as to allow a ceramic slurry forming the mold to penetrate it in order to form said transition layer.

This allows for a transition layer which is both strong and flexible enough to compensate for shrinkage/expansion of the mold during heating/cooling, thereby reducing the chances for forming of cracks.

The casting mold can further comprise an auxiliary layer, external to the main layer, which is also permeable. The auxiliary layer can be configured for thickening the mold, and subsequently the casting space, to allow better vacuum uniformity during casting.

The auxiliary layer can have a lower heat resistance coefficient than that of said main layer, and be made, for example of polymeric material.

It should be noted that, unlike the main layer, the auxiliary layer can be is reusable.

According to still a further aspect of the subject matter of the present application, there is provided a method of manufacturing the above casting mold, said method comprising the step of:

a) providing a model of the item to be cast;

b) forming a mold box around said model with an interior mimicking the envelope of the model and spaced therefrom to form a cavity around the model;

c) placing a permeable layer against the interior's surface;

d) filling said cavity with slurry material during which the slurry permeates into said permeable layer to form a transition layer and providing a setting time allowing for the slurry to harden; and e) providing conditions, under which material from which the model is made can be extracted from the mold without disassembling of the mold.

In particular, step (e) of the method can include introducing the solid mold into a furnace sufficiently hot as to allow said model to melt and leave a cavity within said solid mold in the shape of said item to be cast.

Alternatively, step (e) of the method can include introducing a dissolving material to the solid mold configured for dissolving the model and leave a cavity within said solid mold in the shape of said item to be cast.

According to still another aspect of the subject matter of the present application, there is provided a method for casting a cast item using a casting mold having pores, said method comprising the step of:

a) placing the casting mold within a sealed casting space provided with at least one ingress and at least one vacuum egress;

b) introducing, through said at least one ingress, gas into said sealed casting space at high pressure to cause said gas to permeate into said pores;

c) withdrawing gas from said sealed casting space via said at least one vacuum outlet, thereby withdrawing at least part of the gas contained within pores of said casting mold; and d) casting molten casting material into said mold to form said cast item.

The above method can further comprise a setting step (b') after step (b), during which the gas is allowed to linger within the sealed casting space to better permeate the casting mold.

In connection with all aspect described above, herein presented a new way for investing slurry into ceramic blanket, which replaces the flask and/or flange, used generally in vacuum investment castings, and combines with the casting body by creating a compound material. This compound holds the casting body during cooling after heating in the furnace and prevents shrinkages cracks. It's permeable and makes a substitute also for vacuum chamber around the casting mold.

The technique described herein combines benefits from all the systems described above for the production of top quality castings. The vacuum chamber, vacuum valve and flask were replaced by a diaphragm together with a hot and cold permeable layer. These aspects simplify the process, reduce costs significantly, annul geometry and size limitation, reduce ceramic consumption, reduce cracks during casting mold cooling, reduce time for cleaning the ceramic from the casting, enable casting mold suspension in protective gas and casting with protective gas permeating every pore of the casting mold in its entirety, enable casting in an ultimate vacuum as well, and enable casting mold making by various methods.

The above aspect of the present application can provide, inter alia, at least some of the following advantages:

- The casting mold can be suspended in protective gas for optimal penetration or reaction. This, in comparison to gas wash, with penetration only to the pores adjacent to the cavity.
- During casting, the item is uniformly surrounded with protective gas.
- No need for a flask for each casting.
- Cracks in the casting mold during cooling after heating in the furnace, are avoided, in comparison to the conventional method, were during cooling, expansion—shrinkage cracks appear due to the interface of flask with the mold.
- The part size and geometry is unlimited, and depends only on the table size.
- Slurry consumption is minimized, due to the ability to design a frame in the projection of the pattern (FIG. 2)
- Releasing the part from the casting mold is much faster when no flask is involved.
- The casting mold can be enclosed in a total vacuum before pouring, for good penetration.
- A fast cooling process can be imposed, either with water or a solution.
- Various molding methods for what is known as "lost wax casting" can be used.
- The cheapest method, in comparison to all the known vacuum methods.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

The casting mold preparation suggested herein uses the investment method. Casting mold herein combines a body (slurry after drying) together with one or two layers as will be discussed later on. The die suggested herein for the casting mold preparation is a frame made of plastic or metal (C). The frame can be designed in accordance with the unique shape of the part to be cast. The method described herein enables changing the sample orientation in a very simple manner, which simplifies the development process, and enables optimization between all casting considerations for best quality. It also enables cost reduction by lowering the slurry consumption.

Figure 1A:
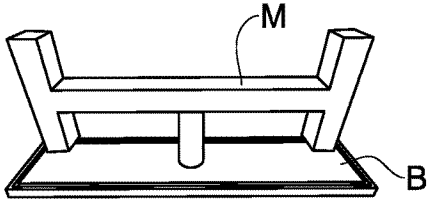
FIGS. 1A to 1F are schematic isometric views showing consecutive stages of manufacturing a casting mold according to the present application.

With reference to FIGS. 1A to 1F, the Various stages of forming a casting mold: are shown. In FIG. 1A, the model M (generally referred to as a 'wax pattern'), mimicking the object to be cast, is shown positioned on a base B. The frame is installed on a silicon base (B). The wax pattern M can be mounted on the silicon base or hung from the top base.

Figure 1B:
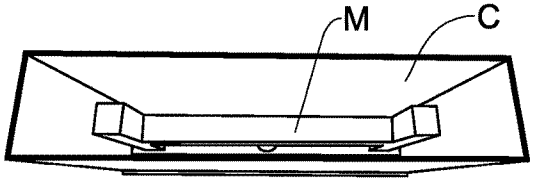

Thereafter, a case C is constructed around the model M, compactly fitting the dimensions of the model. M, as shown in FIG. 1B. The case is mounted on the silicon base B in an upright position.

Figure 1C:
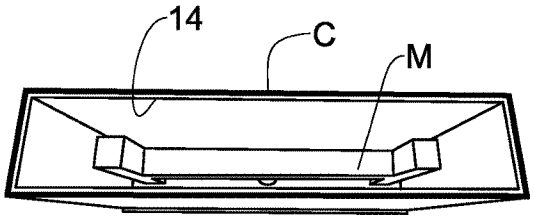

At the next stage, shown in FIG. 1C, a ceramic blanket 14 is inserted into the case C, fitted against the inner surface thereof. Fibers from heat resistant material are placed along the internal side of the frame walls. Its thickness and toughness allow the ceramic blanket to maintain its shape and stability after placement, and throughout the slurry pouring. This layer is called herein "hot permeable layer" or "main layer". The main layer has at least two applications:

a. preventing casting mold cracks during cooling. The slurry slightly penetrates the ceramic blanket. The penetrated thickness of the ceramic becomes a compound layer—ceramic body and ceramic fibers. The compound layer is strong and flexible which enables a good reaction to expansion/shrinkage during heating and cooling and therefore prevents cracks. The total order: body-body+fibers-fibers, is a strong and flexible order which enables good crack protection (in addition, it is preferable to use a steel net or fibers at the top or bottom of the casting mold base for extra strengthening).

b. creating a permeable layer around the body for good protective gas penetration, and a good, uniform vacuum around the cast. There is only a partial permeation of the slurry to the ceramic blanket and the remainder of the blanket thickness retains its original qualities. This section of the ceramic blanket replaces the conventional vacuum chamber space.

Figure 1D:
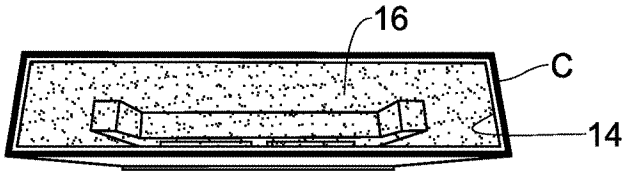

Other suggestions for use of ceramic blanket—ceramic blanket can also be used as cover of the inner side of a flask—sealed or perforated. In a sealed flask, it creates a vacuum chamber on the inner surface of the flask and avoids cracks. In a perforated flask, it enable avoiding cracks without harming the vacuum Following the above, the internal space of the case C is filled with a slurry 16 as shown in FIG. 1D, and the bubble treatment begins (the common methods are vibration and vacuum treatment).

Figure 1E:
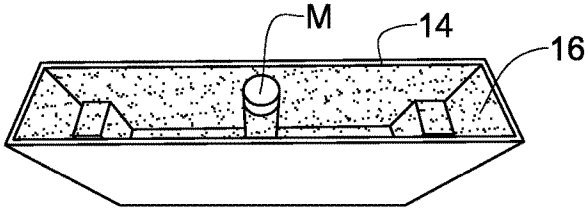

Once the slurry is hardened, the case C can be removed as shown in FIG. 1E, during which the die (frame and silicon base) is disassembled leaving a solid mold (also referred herein as "body"), wrapped in a ceramic fibrous blanket 14.

Figure 1F:
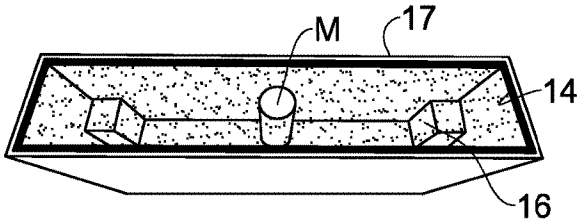
Figure 2D:
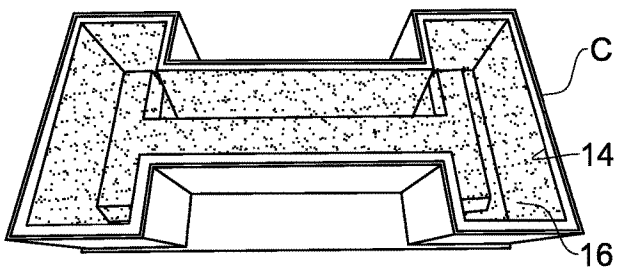
FIGS. 2A to 2F are schematic isometric views showing consecutive stages of manufacturing a casting mold according to another example of the present application.
Figure 2E:
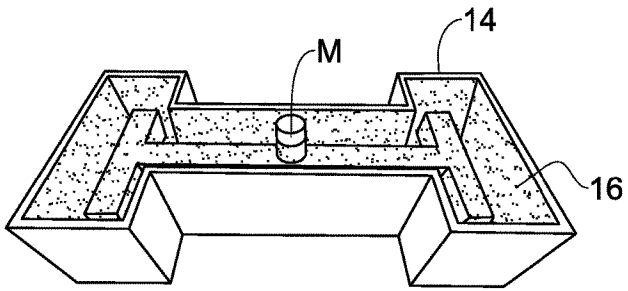
Figure 2F:
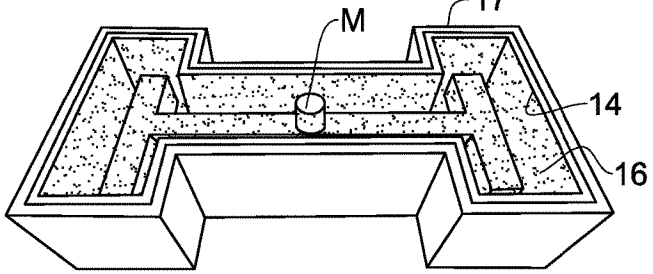
Figure 2A:
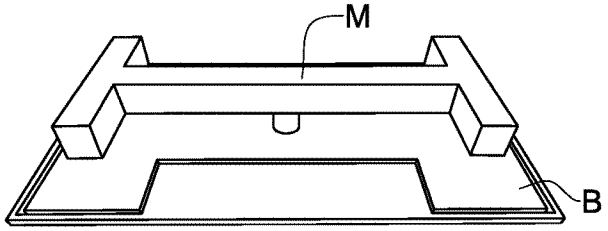
Figure 2B:
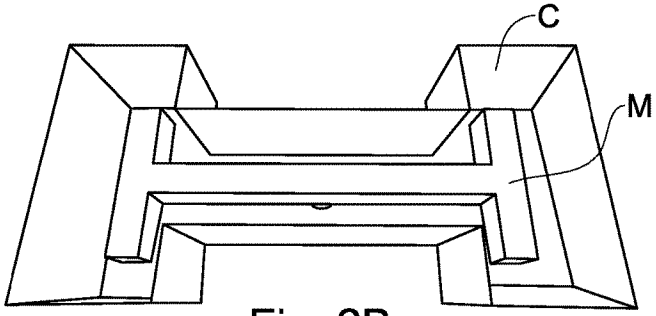
Figure 2C:
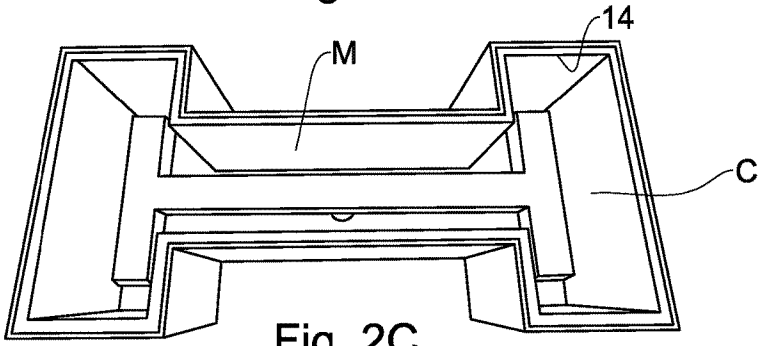

It is appreciated that drying and heating in the furnace can be performed. After cooling to a given point, the body with the ceramic blanket can be wrapped with an additional permeable layer as shown in FIG. 1F, referred herein as "cold permeable layer" or "auxiliary layer" (17).

As will be explained in detail with respect to FIGS. 3 to 5F, during casting, the diaphragm, together with the two layers, create a "vacuum chamber" around the casting mold. The aim of the cold permeable layer 17 is to thicken the chamber in order to get better vacuum uniformity around the cast. The cold permeable layer material can be less heat resistant than the hot permeable layer, with less strength, much bigger pores and higher pore density. For the cold permeable layer a polymeric fabric can be used. This fabric can be reused many times.

With reference to FIGS. 2A to 2F, the stages of forming a casting mold are shown, this time at a different positioning of the model M. In FIG. 1, the frame shape is rectangular, however for the orientation in FIG. 2A, a frame following the contour of the part saves slurry consumption, compared to a rectangular design of the box being placed around the model M as oriented in FIG. 2A.

It is appreciated that while the stages of forming the mold are the same, the orientation of the model M and the shape of the box allow optimization of the space and amount of slurry required.

The casting system S comprises a casting surface, casting mold, an impermeable diaphragm configured for covering said casting mold when positioned on said casting surface, so as to form with said casting surface a casting space, and at least one outlet configured for withdrawing gas from said sealed casting space. An addition of an inlet configured for inflating gas into the casting space makes great advantage as will discuss further.

Figure 3:
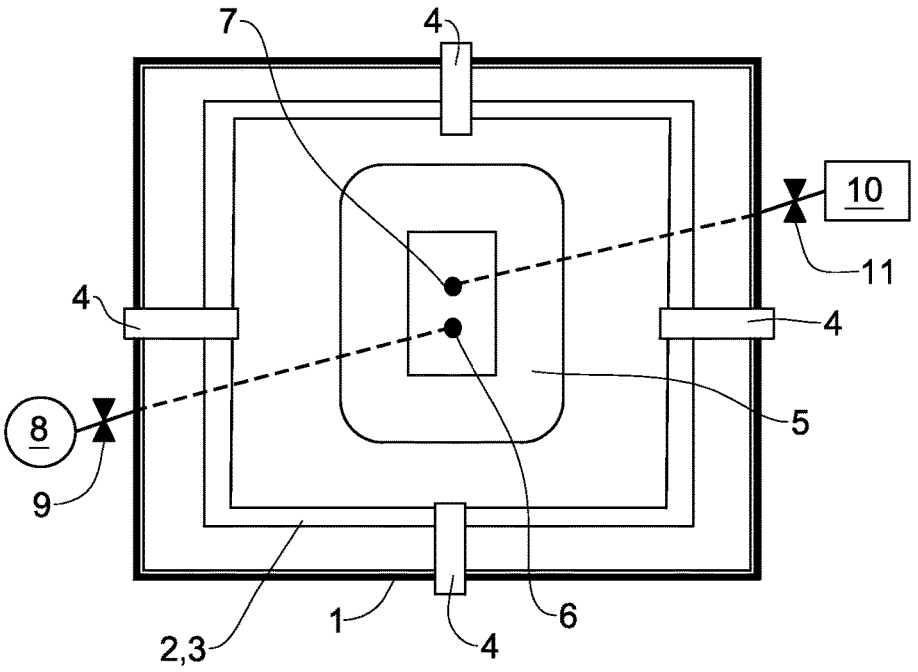
FIG. 3 is a schematic top view of a casting system according to the present application.
Figure 4:
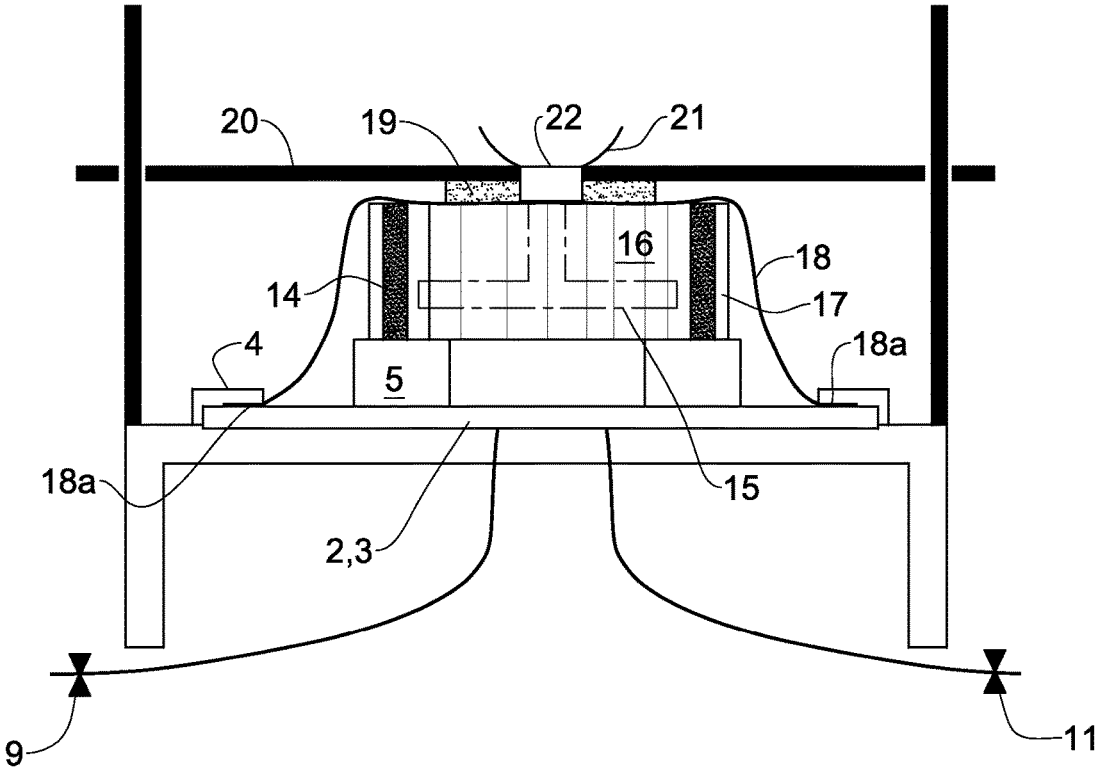
FIG. 4 is a schematic side view of the casting system shown in FIG. 3, shown during a casting process.

With particular reference being made to FIGS. 3 and 4, the casting system S comprises a casting surface in the form of a casting table (1), a sealing frame (2) with a rubber seal (3), clamps (4), and a stand for placement of the casting mold (5). A soft stand is recommended. Sealing frame (2) rubber seal (3) and clamps (4) are also called herein "sealing arrangement".

Two nozzles—inlet (6) and outlet (7), are located on table in an area which is configured for forming part of the casting space. The inlet nozzle (also "inlet") is connected via a tube to a protective gas tank (8) with a valve (9), and the outlet nozzle (also "outlet") is connected via a tube to a vacuum machine (10) with a valve (11).

With reference now being made to FIGS. 5A to 5F, the casting mold is positioned on the stand (5) in a way that the inlet and outlet nozzles are located below the casting mold. The diaphragm 18 is placed over the casting mold so that the outer edge of the impermeable diaphragm (18) is anchored to the sealing arrangement via its edge area 18*a* (see FIG. 4), thereby forming a casting space which is constituted by the casting surface of the table 1, and the diaphragm (forming its top and side portions). The space which is created by anchoring the diaphragm to the casting table is called herein "casting space".

The impermeable diaphragm is flexible, strong, and heat resistant to the casting mold temperature before casting, but will melt at the temperature of the liquid metal.

To insure protection of the diaphragm from liquid metal droplets, a ceramic blanket (19) and a metal sheet (20), which is called herein also "protective element", are placed above the sprue, leaving the sprue exposed. A funnel (21) and filter (22) are placed on the metal sheet, above the sprue.

After positioning the casting mold, attaching the diaphragm, positioning the protective blanket, ceramic blanket and protective element and assuring that valve (11) is closed, valve (9) is opened. Protective gas inflates the diaphragm and penetrates to the casting mold's pores. When the diaphragm is fully inflated, valve (9) is closed. At this point it is suggested allowing a suspension or rest time. In any case, inflation of the diaphragm with protective gas enables good gas penetration to the casting mold's pores which promises a protective atmosphere all around the cavity during casting. Inflating the diaphragm also enables leakage testing before the vacuum operation.

Before casting, valve (11) is opened and the vacuum machine (10) is turned on. The diaphragm wraps the casting mold. The vacuum suction works all around the cavity thanks to the permeable layers that surround the casting mold. Initially, the diaphragm attaches to the casting mold and only after that, the diaphragm adheres to the sprue.

At this point, the casting mold may still contain remnants of gas that flow to the cavity before and during casting. The timing for pouring can be controlled by a vacuum gage, to the point where the casting mold still contains some remnants of gas but the vacuum is strong enough for casting. After pouring, a protective gas supply above the sprue may be beneficial.

After the metal solidifies, the vacuum machine is shut off, and the valve (11) is closed.

Figure 5A:
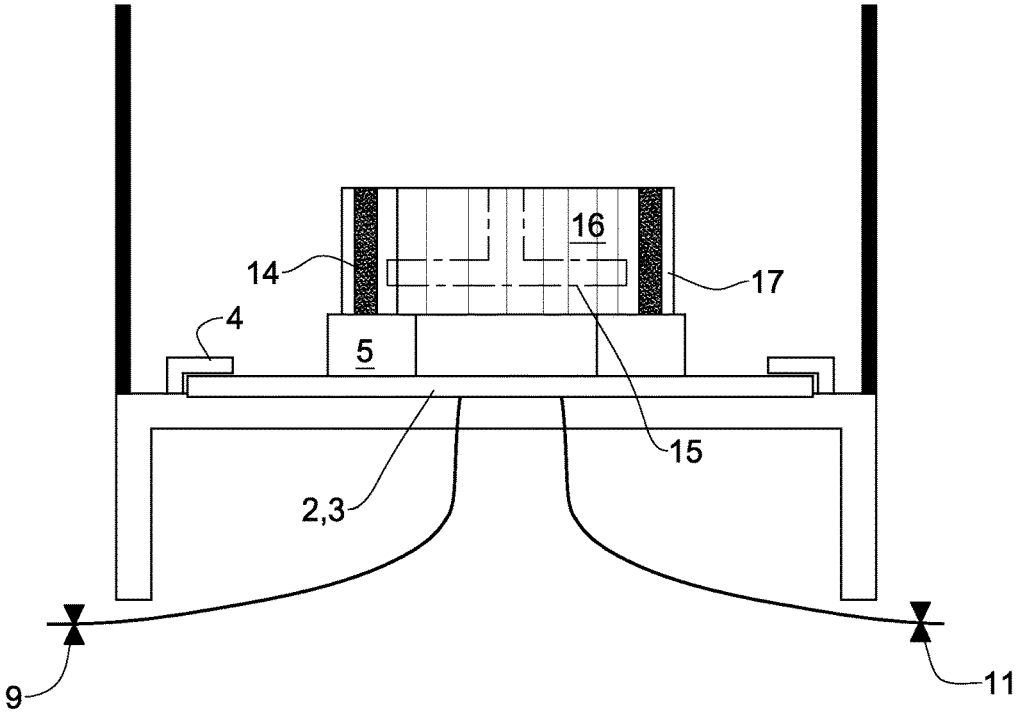
FIGS. 5A to 5F are schematic side views of consecutive stages of casting an item using the system shown in FIGS. 3 and 4.
Figure 5B:
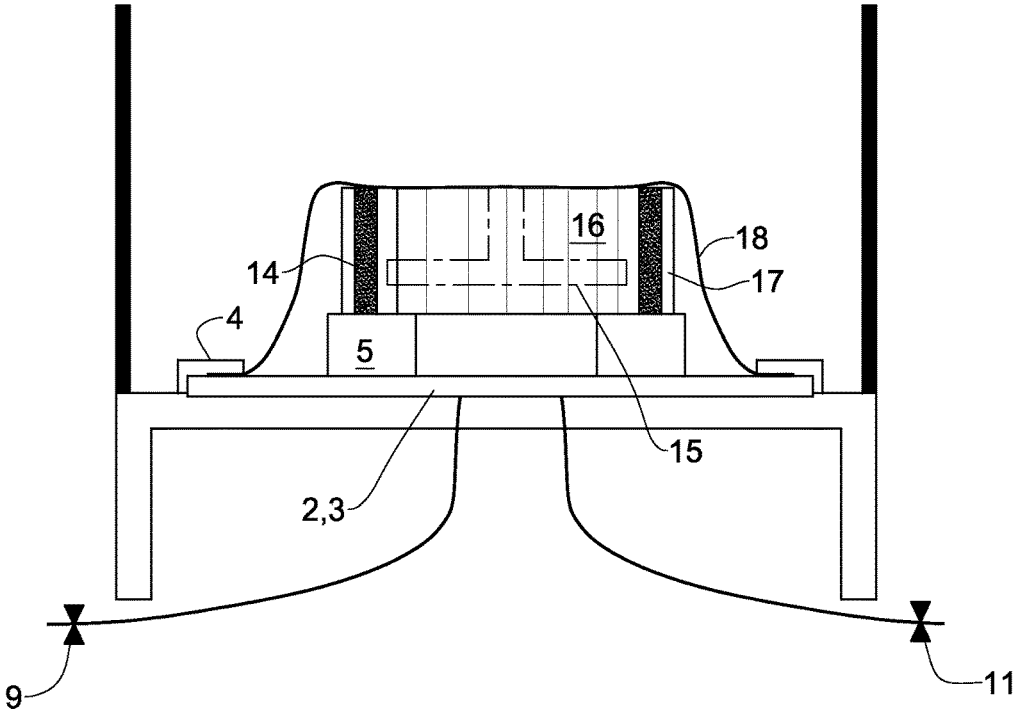
Figure 5C:
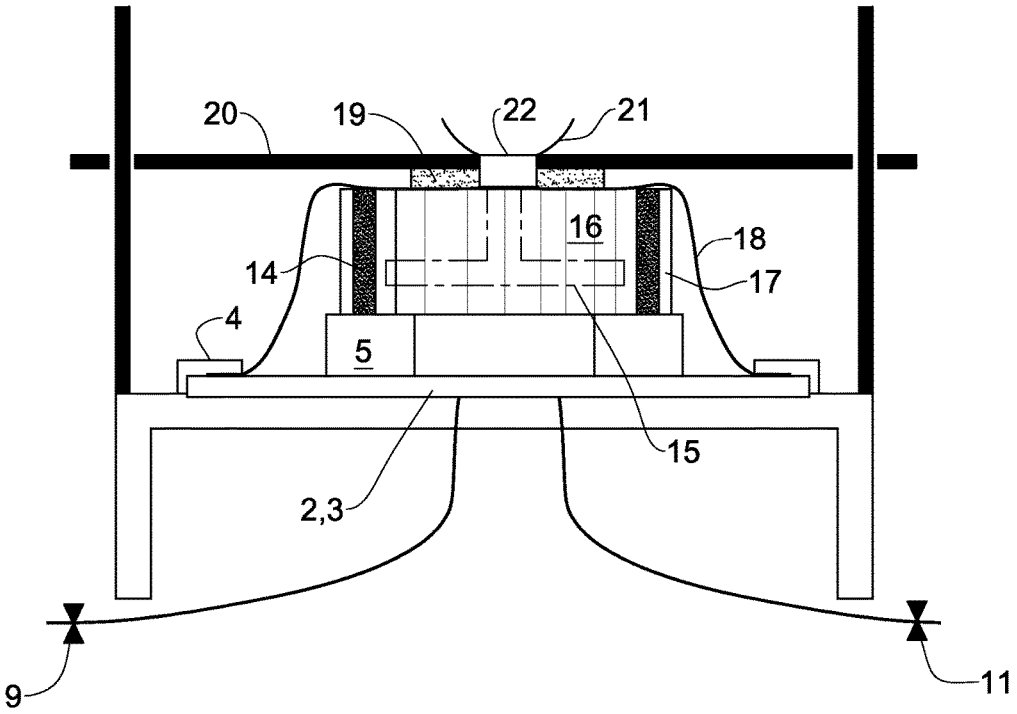
Figure 5D:
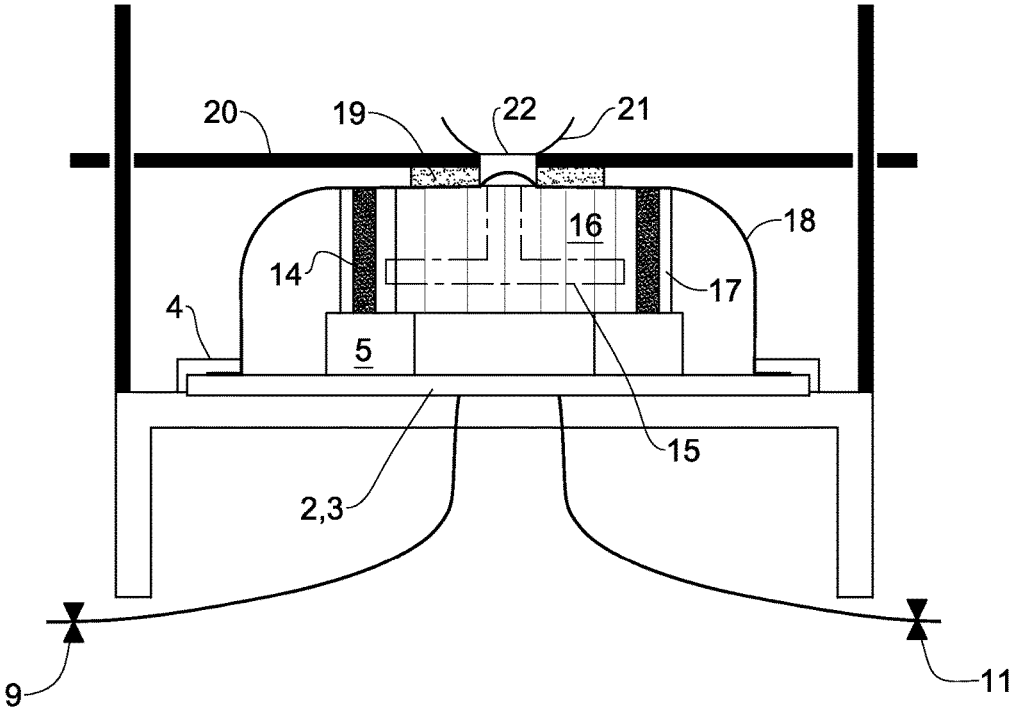
Figure 5E:
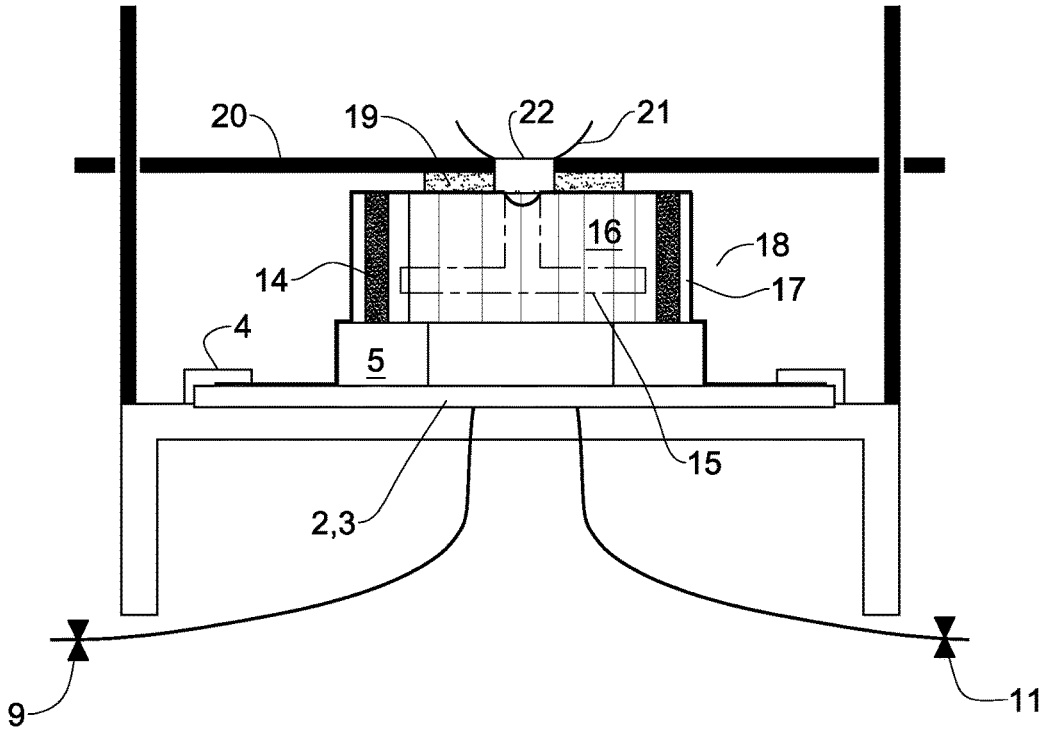
Figure 5F:
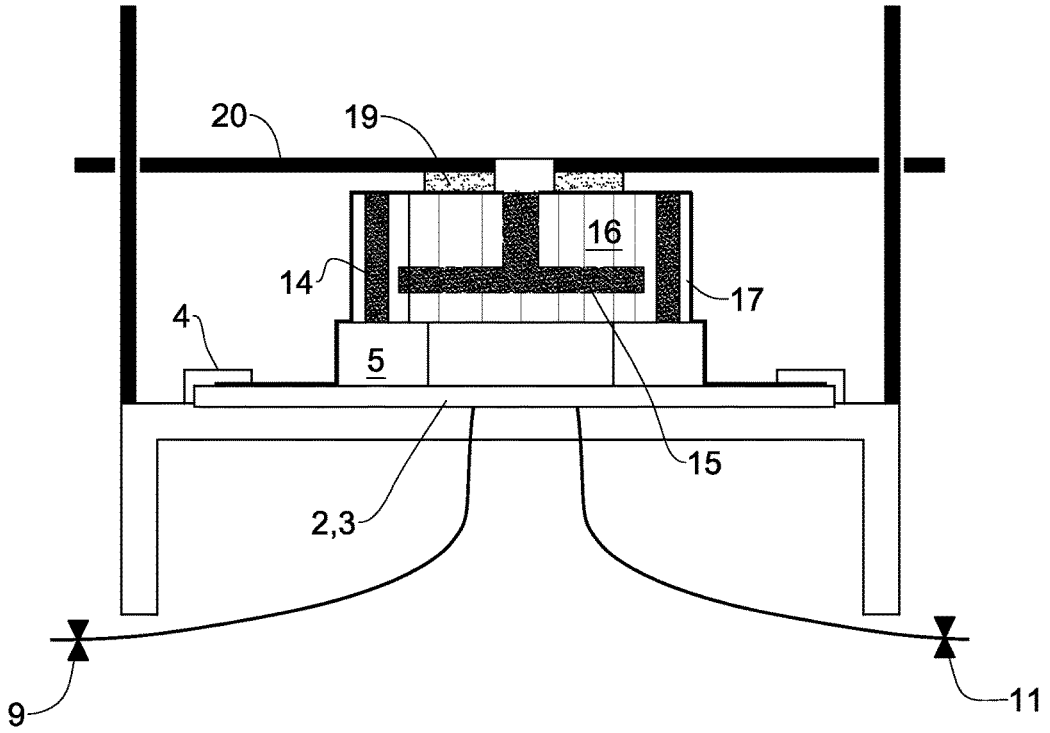

FIGS. 5A to 5F show the process steps. In FIG. 5A the casting mold is positioned on the casting surface. In FIG. 5B the outer edge of the impermeable diaphragm is anchored around and above the casting mold. In FIG. 5C a ceramic blanket, metal sheet ("protective element"), funnel and filter are added to the system. In FIG. 5D, protective gas inflates the diaphragm and in FIG. 5E, the vacuum machine is turned on and the diaphragm wraps the casting mold. FIG. 5F present the system after pouring the liquid into the cavity.

Figure 6:
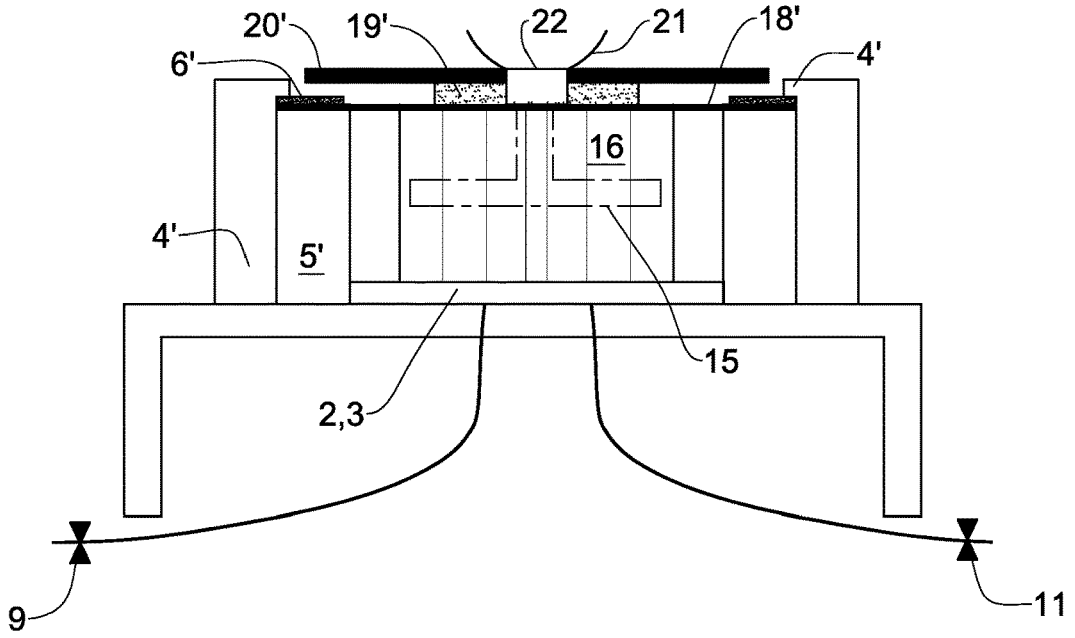
FIG. 6 is a schematic side view of another example of a casting system according to the present application.

Turning now to FIG. 6, another example of a casting system S' is shown, in which the casting table comprises a casting surface 2 and a side wall 5' having, at a top end thereof, a rim area. This side wall 5' forms a portion of the casting space, so that when the diaphragm 18' is positioned over the side wall and is secured to the fastening arrangement, the casting space is defined by:

a base constituted by the casting surface 2;

a side portion constituted by the side wall 5'; and a casting face constituted by the diaphragm 18'.

Figure 7:
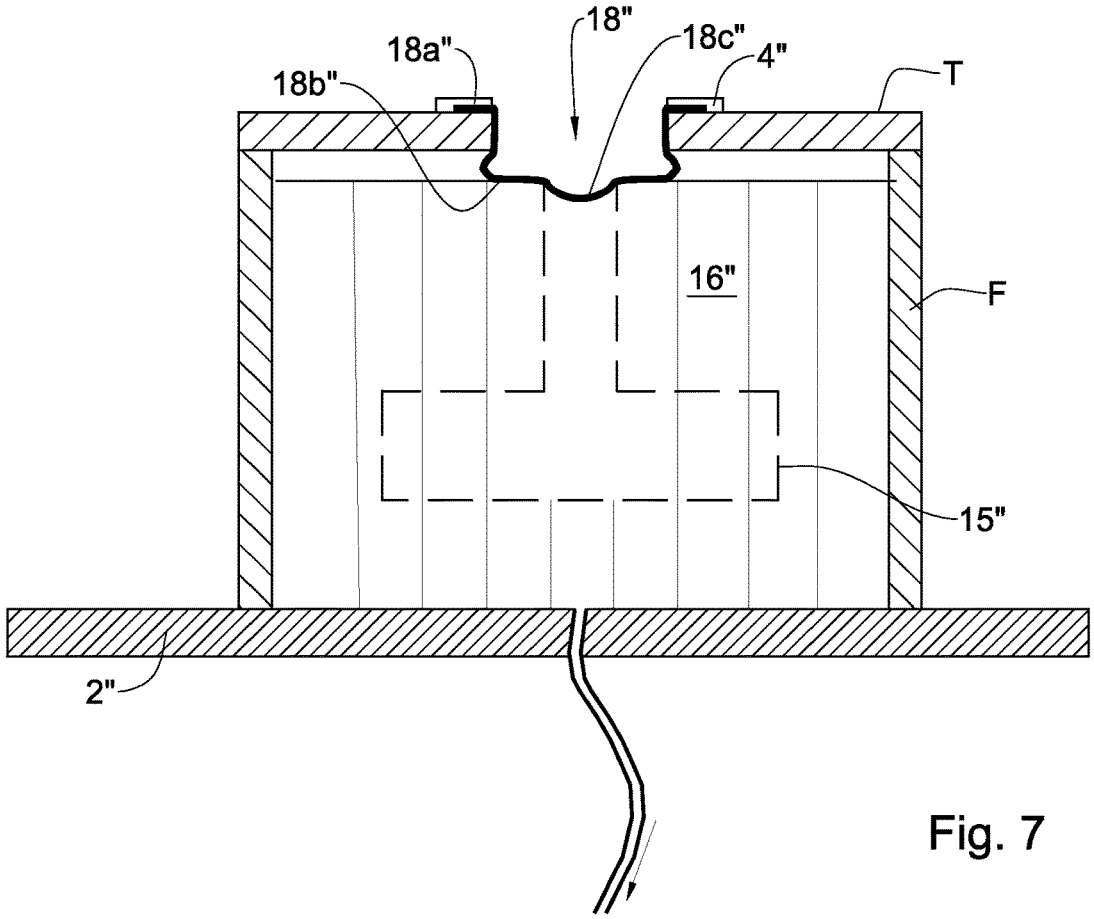
FIG. 7 is a schematic cross-section view of a casting system comprising a casting mold according to another example of the present application.

The diaphragm 18' is so dimensioned that it has a central portion configured for being juxtaposed with the opening of the mold through which molten material is poured therein, and a peripheral area, constituting the boundary area, which adheres to the casting mold under the application of vacuum (these are demonstrated in FIG. 7 with respect to another configuration of the casting system). Thus, when the central area of the diaphragm is breached by being melted away by the cast molten material, the peripheral area is still adhered to the casting mold, maintaining the required vacuum during casting. It is noted that since the diaphragm is breached, the level of vacuum may not be identical to that before the breaching, but it is still sufficient for maintaining a 20 required level for the purpose of casting.

One of the advantages of this unique design, both in the casting system S and the casting system S' described above, lies in the fact that the diaphragm, when vacuum is applied, adheres to the casting mold. This allows the casting system with a greater degree of flexibility in terms of the molds which can be used in the system.

Turning now to FIG. 7, another example of a casting system is shown in which the casting system further comprises a side wall F and a top closure T, both being rigid. The top closure T constitutes a part of the casting face and is formed with an opening through which molten material is cast into the cavity 15" of the mold 16".

The diaphragm 18" comprises an edge area 18*a"*, a peripheral area 18*b"* and a central area 18*c"*, constituting the remainder of the casting face. The arrangement is such that upon application of vacuum to the casting space, as shown in FIG. 7, the central portion 18*c"* of the diaphragm 18" is sucked into the sprue and the peripheral area 18*b"* is adhered to an area surrounding the sprue.

Thereafter, when molten material is introduced into the mold through the casting face, it melts away the central portion 18*c"* of the diaphragm 18". However, as long as air is removed from the casting space via the outlet (designated by the arrow below the casting surface), the peripheral portion 18*c"* of the diaphragm 18" remains adhered to the surrounding area of the sprue, whereby a certain level of vacuum in the casting space is maintained.

This arrangement of the diaphragm allows maintaining the required level of vacuum during the entire casting process, even after the central portion 18*c"* has been melted away, thereby optimizing the casting process.

Those skilled in the art to which this invention pertains will readily appreciate that numerous changes, variations, and modifications can be made without departing from the scope of the invention, mutatis mutandis.

The invention claimed is:

1. A casting system for the manufacture of a cast item by pouring molten casting material in a casting mold, the casting system comprising:

a casting surface for positioning the casting mold thereon;

a rim area disposed on the casting surface;

a heat resistant impermeable diaphragm having a predetermined heat resistance coefficient and an edge area, the heat resistant impermeable diaphragm configured for covering a portion of the casting mold when the latter is positioned on the casting surface so as to form a casting space defined by at least a base constituted by the casting surface and at least a casting face constituted, at least in part, by the heat resistant impermeable diaphragm;

a sealing arrangement configured for sealingly engaging the rim area of the casting surface and the edge area of the heat resistant impermeable diaphragm, thereby sealing the casting space; and at least one outlet configured for withdrawing gas from the sealed casting space; wherein the heat resistance coefficient is such that the heat resistant impermeable diaphragm can melt when coming in contact with the molten casting material;

wherein the heat resistant impermeable diaphragm covers an area larger than that through which molten material is cast so that, when the casting space is sealed, application of vacuum to the sealed casting space through the at least one outlet causes the heat resistant impermeable diaphragm to adhere to a portion of the casting mold located juxtaposed with the casting face.

2. The casting system according to claim 1, wherein the rim area is constituted by a part of the casting surface itself; and wherein the heat resistant impermeable diaphragm is configured for covering a majority of the casting mold, thereby constituting not only the casting face but also a remainder of the casting space except for the base.

3. The casting system according to claim 2, wherein the heat resistant impermeable diaphragm wraps and encompasses the casting mold.

4. The casting system according to claim 1, wherein the casting surface is provided with a projecting side wall having, at an end thereof remote from the casting surface, the rim area, wherein the heat resistant impermeable diaphragm constitutes a majority or at least a part of only the casting face while the remainder of the casting space is constituted by the base and the projecting side wall.

5. The casting system according to claim 4, wherein the heat resistant impermeable diaphragm adheres only to a majority or at least a part of the casting face of the casting mold.

6. The casting system according to claim 1, wherein the heat resistant impermeable diaphragm is so dimensioned that the heat resistant impermeable diaphragm has a central portion configured for being juxtaposed with the opening of the casting mold through which molten material is poured therein, and a peripheral area, constituting a boundary area, which adheres to the casting mold under the application of vacuum.

7. The casting system according to claim 6, wherein, when the central portion of the heat resistant impermeable diaphragm is breached by being melted away by the cast molten material, the peripheral area is configured for remaining adhered to the casting mold, maintaining a required vacuum during casting.

8. The casting system according to claim 1, wherein the casting surface includes a stand configured for positioning the casting mold thereon, the stand configured to provide a space between the casting mold and the at least one outlet.

9. The casting system according to claim 1, further comprising at least one inlet configured for introduction of gas into the casting space.

10. The casting system according to claim 1, wherein when the casting space is sealed, application of gas through the at least one inlet, causes the heat resistant impermeable diaphragm to inflate.

11. The casting system according to claim 1, wherein the heat resistant impermeable diaphragm is provided with at least one protective element configured for preventing droplets of molten casting material from coming in contact with the heat resistant impermeable diaphragm.

* * * * *